US010648424B2

(12) United States Patent
Schlee

(10) Patent No.: US 10,648,424 B2
(45) Date of Patent: May 12, 2020

(54) PRESS-FIT SLEEVE FOR A CYLINDER HEAD

(71) Applicant: MAN Truck & Bus AG, München (DE)

(72) Inventor: Dimitri Schlee, Bamberg (DE)

(73) Assignee: MAN TRUCK & BUS AG, München (DE)

( * ) Notice: Subject to any disclaimer, the term of this patent is extended or adjusted under 35 U.S.C. 154(b) by 0 days.

(21) Appl. No.: 16/016,204

(22) Filed: Jun. 22, 2018

(65) Prior Publication Data

US 2019/0017464 A1 Jan. 17, 2019

(30) Foreign Application Priority Data

Jul. 11, 2017 (DE) ..... 10 2017 115 461

(51) Int. Cl.

| | |
|---|---|
| ***F02F 1/36*** | (2006.01) |
| ***F01P 3/02*** | (2006.01) |
| ***F01P 3/16*** | (2006.01) |
| ***F02M 61/14*** | (2006.01) |
| ***F02F 1/24*** | (2006.01) |
| ***F02M 53/04*** | (2006.01) |
| ***H01T 13/08*** | (2006.01) |

(52) U.S. Cl.

CPC ..... *F02F 1/36* (2013.01); *F01P 3/02* (2013.01); *F01P 3/16* (2013.01); *F02F 1/242* (2013.01); *F02M 53/043* (2013.01); *F02M 61/14* (2013.01); *H01T 13/08* (2013.01); *F01P 2003/024* (2013.01); *F02M 2200/858* (2013.01)

(58) Field of Classification Search

CPC ... F02F 1/242; F02M 61/14; F02M 2200/858; F01P 3/16

See application file for complete search history.

(56) References Cited

U.S. PATENT DOCUMENTS 5,345,913 A * 9/1994 Belshaw ..... F02M 57/02 123/470
2002/0157629 A1* 10/2002 Inagaki ..... F02F 1/242 123/169 PA (Continued)

FOREIGN PATENT DOCUMENTS

CN 200978752 Y 11/2007
CN 201925038 U 8/2011

(Continued)

*Primary Examiner* — Long T Tran

(74) *Attorney, Agent, or Firm* — Weber Rosselli & Cannon LLP

(57) ABSTRACT

A press-fit sleeve for sealing and cooling a component projecting through a fire deck opening in the cylinder head of an internal combustion engine is described. The press-fit sleeve includes a connecting point at a first end of the press-fit sleeve, said connecting point being designed for press fitting into an indentation at an end of the fire deck opening that faces away from a combustion chamber. Furthermore, the press-fit sleeve includes a radially inwardly protruding step at a second end of the press-fit sleeve lying opposite the first end. Between the first end and the second end, the press-fit sleeve includes a lateral surface which is closed in a fluid-tight manner and is or can be brought into contact with a water jacket surrounding the press-fit sleeve.

14 Claims, 2 Drawing Sheets

(56) References Cited

U.S. PATENT DOCUMENTS

| | | | | |
|---|---|---|---|---|
| 2011/0083622 | A1* | 4/2011 | Megel | F02F 1/242 123/41.72 |
| 2011/0083624 | A1* | 4/2011 | Megel | F02F 1/242 123/41.82 R |
| 2015/0211410 | A1* | 7/2015 | Saville | F02M 53/043 123/41.52 |
| 2017/0051713 | A1* | 2/2017 | Peters | F02M 53/043 |

FOREIGN PATENT DOCUMENTS

| | | | |
|---|---|---|---|
| DE | 2745313 | A1 | 9/1978 |
| DE | 4119594 | C2 | 7/1998 |
| DE | 112010003755 | B4 | 6/2015 |
| FR | 2662471 | A1 | 11/1991 |
| FR | 2910555 | A3 | 6/2008 |
| GB | 774206 | A | 5/1957 |
| GB | 1576926 | A | 10/1980 |
| JP | S63160351 | U | 10/1988 |
| WO | 2014020298 | A1 | 2/2014 |

* cited by examiner

PRESS-FIT SLEEVE FOR A CYLINDER HEAD

BACKGROUND

The present disclosure relates to a press-fit sleeve for inserting into a fire deck opening of a cylinder head of an internal combustion engine. In particular, a press-fit sleeve for sealing and cooling a component protruding through a fire deck opening in the cylinder head of an internal combustion engine and a corresponding cylinder head are described.

Known cylinder heads of an internal combustion engine have, per cylinder, at least one dome which is intended for receiving a spark plug or an injection nozzle. Each dome is surrounded by a cooling liquid chamber. Document DE 41 19 594 C2 describes such a cylinder head for an internal combustion engine.

Threaded sleeves are ever more frequently used for the spark plugs or the injection nozzles in the cylinder head. In comparison to the cast-on dome, the use of a sleeve improves the cooling of the spark plug or of the injection nozzle significantly because of a thin wall and good heat conductivity of the sleeve. Furthermore, the production of such cylinder heads is simpler.

Such sleeves are customarily screwed into the fire deck of a cylinder head. The external thread of the sleeve and the internal thread on the fire deck are sealed here. In the upper region, the sleeve is mounted freely and is sealed by means of an O ring. Such a conventional sleeve is readily suitable for the use of a diesel injection nozzle since the tip of the injection nozzle is narrow. The injection nozzle itself is introduced from above and does not have any thread at the end facing the combustion chamber.

In contrast to the injection nozzle, a spark plug requires considerably more space in the lower region of the fire deck, i.e. in the region facing the combustion chamber. In addition, the spark plug has to be screwed in and unscrewed with a certain torque. When the spark plug is screwed in and unscrewed, there is the risk of twisting the sleeve in relation to the cylinder head, for example of unintentionally unscrewing the sleeve. As a result, additional working steps arise. Furthermore, the tightness of the thread may be irreversibly damaged.

Moreover, the use of a sleeve requires a greater diameter of the fire deck opening in comparison to the outside diameter of the injection nozzle or of the spark plug, as a result of which the oscillation strength, in particular the flexural fatigue strength and the endurance strength, of the fire deck deteriorate.

SUMMARY

One aspect of the present disclosure is directed to a sleeve for sealing and cooling a component protruding through a fire deck opening in the cylinder head of an internal combustion engine, said sleeve permitting a more compact construction in the fire deck opening. A more extensive or alternative aspect is to specify a sleeve for sealing and cooling a component projecting through a fire deck opening in the cylinder head of an internal combustion engine, said sleeve avoiding unintentional unscrewing and/or the tightness of the sleeve in relation to the fire deck not being adversely affected by replacement of the component.

These aspects are achieved by a press-fit sleeve, a cylinder head with such a press-fit sleeve and a vehicle with such a cylinder head with the features of the present disclosure.

According to one aspect of the disclosure, a press-fit sleeve is provided for sealing and cooling a component projecting through a fire deck opening in the cylinder head of an internal combustion engine. The press-fit sleeve comprises a connecting point at a first end of the press-fit sleeve, said connecting point being designed for press fitting into an indentation at an end of the fire deck opening that faces away from a combustion chamber. Furthermore, the press-fit sleeve comprises a radially inwardly protruding step at a second end of the press-fit sleeve lying opposite the first end and a lateral surface of the press-fit sleeve, said lateral surface being closed fluid-tightly between the first end and the second end and being or being able to be brought into contact with a water jacket surrounding the press-fit sleeve.

The press-fit sleeve can be arranged or arrangeable between the component and the fire deck (for example between the component and the fire deck opening). The component can comprise an external thread for screwing in the cylinder head (for example in the fire deck opening between the indentation and the combustion chamber).

The term "fire deck" can refer to a surface of the cylinder head covering the combustion chamber and, perpendicularly to said surface, to a partial volume of the cylinder head including as far as the connecting point. The term "fire deck opening" can relate to a passage opening which extends between the combustion chamber and the connecting point. The term "indentation" can be related to the direction of movement of the press-fit sleeve, the connecting point of which can be "lowered" in the cylinder head for press fitting into the indentation by moving the press-fit sleeve in the direction of the combustion chamber.

The connecting point can be arranged in an encircling manner at the first end of the press-fit sleeve, for example with respect to a longitudinal axis of the press-fit sleeve. The connecting point can be rotationally symmetrical with respect to the longitudinal axis of the press-fit sleeve.

The indentation can be arranged in an encircling manner at the end of the fire deck opening that faces away from the combustion chamber, for example with respect to the longitudinal axis of the press-fit sleeve and/or a longitudinal axis of the fire deck opening. The indentation can be rotationally symmetrical with respect to the longitudinal axis of the press-fit sleeve and/or the longitudinal axis of the fire deck opening.

The connecting point can be formed in a complementary manner with respect to the indentation. In the press-fitting state, the connecting point and the indentation can form an interference fit. In the press-fitting state, the fire deck opening and the press-fit sleeve can be coaxial. The indentation can have a recess or bore which is coaxial with respect to the fire deck opening and the diameter of which is greater than a diameter of the fire deck opening (for example at that end of the fire deck opening which faces the combustion chamber).

The component can comprise an injection nozzle (for example for diesel fuel). Alternatively or additionally, the component can comprise a spark plug.

The connecting point can comprise a cylindrical pressing surface. An axial extent of the connecting point can be much smaller than an axial length of the press-fit sleeve. "Axially" can relate to the direction of the longitudinal axis of the press-fit sleeve. The axial extent of the connecting point can be a height of the indentation, for example a height of the cylindrical pressing surface. The axial extent of the connecting point can correspond to a distance between that end of the fire deck opening which faces away from the combustion chamber (i.e. an end of the indentation which faces away from the combustion chamber) and a contact surface of the indentation (i.e. an end of the indentation that faces the combustion chamber).

The connecting point can comprise a radially inwardly curved collar. The end surface of the collar, i.e. that side of the collar which faces the combustion chamber, can form the contact surface. The contact surface of the connecting point of the press-fit sleeve can be perpendicular to the longitudinal axis of the press-fit sleeve.

The cylindrical pressing surface and/or the contact surface can be designed for connecting fluid-tightly to the indentation. The design for the fluid-tight connection, i.e. the sealing possibility or the fluid-tight closure with respect to the indentation, can comprise an encircling groove for receiving an O ring, for example in the pressing surface and/or the contact surface. An O ring groove can in each case be integrated in the pressing surface and/or the contact surface for the fluid-tight closure of the first end of the pressing sleeve in the fire deck (for example analogously to a fluid-tight closure of the second end of the press-fit sleeve in the cylinder head).

The pressing surface and/or the contact surface can be connected or connectable to the indentation in a force-fitting and/or integrally bonded manner. For example, the indentation can be filled or smoothed out with an adhesive prior to the press fitting. The adhesive can contribute to the mechanical connection and/or to the fluid-tight closure of the first end of the press-fit sleeve in the fire deck.

A diameter (for example an outside diameter) of the press-fit sleeve can be smaller at the first end (for example at the cylindrical pressing surface) than a diameter (for example an outer diameter) of the press-fit sleeve at the second end (for example at the outer circumference of the radially inwardly protruding step). The press-fit sleeve can be designed to be pressed from the end facing away from the combustion chamber in the direction of the combustion chamber into the fire deck opening. The press-fit sleeve can have different diameters (for example outer diameters) along its longitudinal axis. The diameters (for example the outer diameters) of the press-fit sleeve can be constant or increasing (i.e. increase monotonously) from the first end to the second end.

A further aspect relates to a cylinder head of an internal combustion engine. The cylinder head comprises a fire deck with a fire deck opening; a press-fit sleeve for sealing and cooling a component projecting through the fire deck opening according to the above aspect; an indentation at an end of the fire deck opening which faces away from a combustion chamber and is designed for press fitting to the connecting point at the first end of the press-fit sleeve; and a cooling water chamber, which is adjacent to the fire deck, for receiving a water jacket which the lateral surface of the press-fit sleeve closes in a fluid-tight manner between the first end and the second end.

The fire deck opening can have an internal thread between the indentation (for example that end of the indentation which faces the combustion chamber) and an end of the fire deck opening that faces the combustion chamber. The internal thread can be designed for the (for example direct) screw connection to the component.

The component can hold down a radially inner step of the connecting point with respect to the fire deck opening, for example can press same in the direction of the combustion chamber. The component (for example the spark plug) can hold down the radially inner step of the connecting point with respect to the fire deck opening via the screw connection. Alternatively or in addition, the component (for example the injection nozzle) can hold down the radially inner step of the connecting point with respect to the fire deck opening via a claw fastened to the cylinder head.

The press-fit sleeve can be connected or connectable to the fire deck in a form-fitting manner by means of the component (for example by fastening of the component by means of the screw connection and/or the claw).

For holding down the connecting point, the component can comprise a protrusion which lies against or can be brought into contact with the radially inner step. The radially inner step of the connecting point can be that side of the inwardly curved collar of the connecting point that faces away from the combustion chamber.

An inner diameter of an opening of the press-fit sleeve at the second end can be greater than a spanner width of the component. The opening can be bordered at the second end by the radially inwardly protruding step.

An axial extent of the fire deck (for example an axial length of the passage opening) can be greater than the axial extent of the connecting point.

The second end of the press-fit sleeve can be closed fluid-tightly with respect to the cylinder head. A seal arranged at the second end in an encircling manner between the press-fit sleeve and the cylinder head can close the cooling water chamber fluid-tightly at the second end. An encircling groove for receiving the seal (for example an O ring) can be provided in the cylinder head and/or in the press-fit sleeve, at a height of the longitudinal axis that corresponds to the second end.

A further aspect relates to a vehicle which comprises a cylinder head according to the above aspect. The vehicle can be a land vehicle, in particular a motor vehicle (for example a utility vehicle, a passenger vehicle or an off-road vehicle). The utility vehicle can be, for example, a bus, a lorry or a tractor. The vehicle can furthermore be a watercraft.

The internal combustion engine of the vehicle can be coupled or coupleable mechanically to a drive train (for example a ship's propeller or drive wheels) in order to output locomotion energy. Alternatively or additionally, the internal combustion engine can drive units (for example on-board units or structures) of the vehicle. The units can be designed for generating power or can comprise a pump drive (for example for providing hydrostatic driving energy or compressed air).

A further aspect relates to the use of such an internal combustion engine, for example in stationary or mobile use.

BRIEF DESCRIPTION OF THE DRAWINGS

Further features and advantages of the disclosure are described below with reference to the attached drawings, in which.

DETAILED DESCRIPTION

Figure 1:
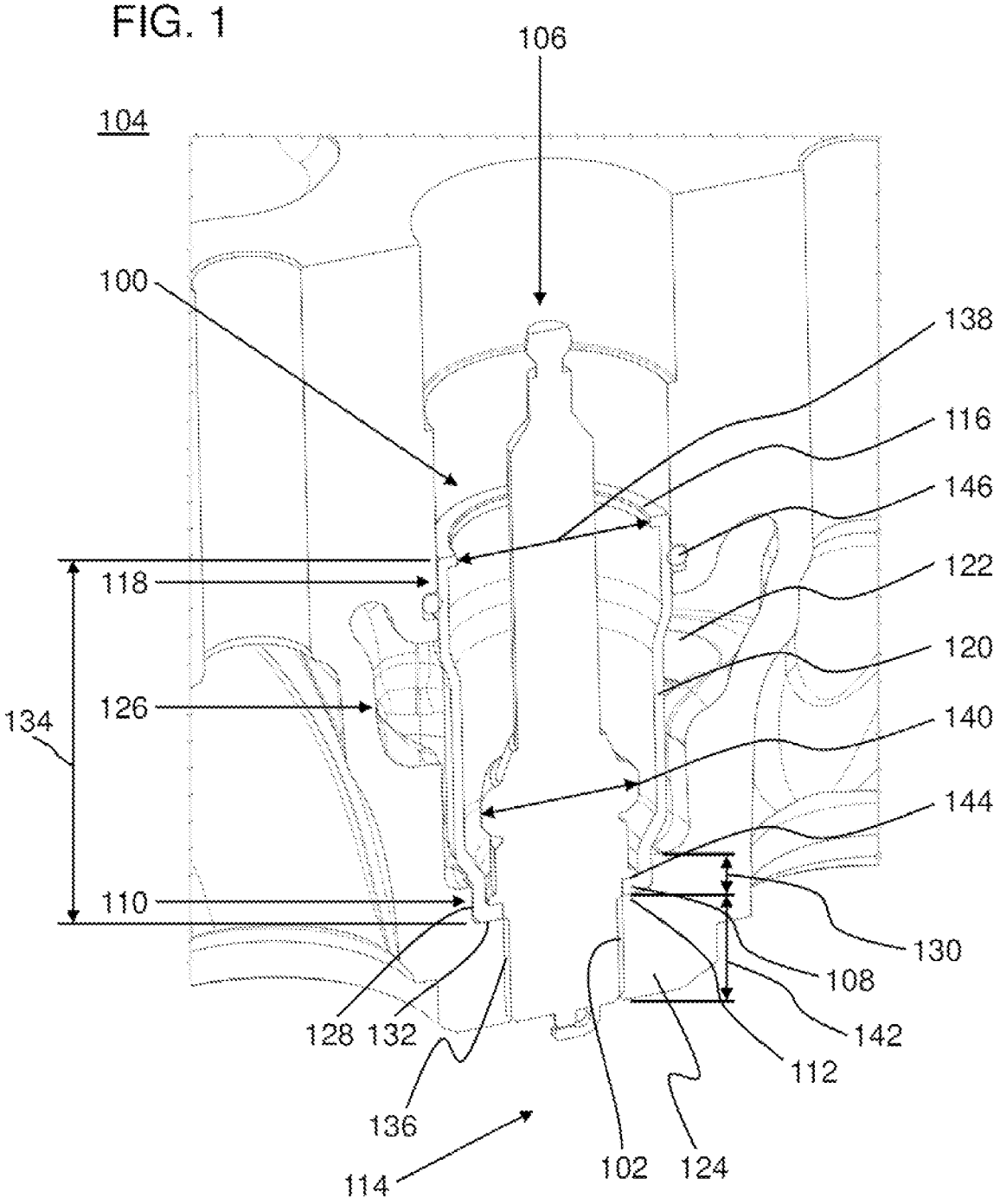
FIG. 1 shows a schematic perspective sectional illustration along a longitudinal axis of an exemplary embodiment of the press-fit sleeve in an exemplary cylinder head.

FIG. 1 schematically shows a section of an exemplary embodiment of a press-fit sleeve, which is denoted in general by reference number 100, for sealing and cooling a component 106 projecting through a fire deck opening 102 in the cylinder head 104 of an internal combustion engine.

The press-fit sleeve 100 comprises a connecting point 108 at a first end 110 of the press-fit sleeve 100. The connecting point 108 is designed for press fitting into an indentation 112 at an end of the fire deck opening that faces away from the combustion chamber 114.

The press-fit sleeve 100 comprises a radially inwardly protruding step 116 at a second end 118 of the press-fit sleeve 100 lying opposite the first end 110 and a lateral surface 120 which is closed fluid-tightly between the first end 110 and the second end 118 and is or can be brought into heat exchange with a water jacket 122 surrounding the press-fit sleeve 100.

The press-fit sleeve 100 can be pulled out of the indentation 112 by means of the radially inwardly protruding step 116. Furthermore, for electric and/or fluidic feed lines, the component 106 projects through an opening at the second end, said opening surrounded by the inwardly protruding step 116. In the exemplary embodiment shown in FIG. 1, the component 106 comprises a spark plug.

In the press-fitting state within the fire deck opening 102 in the fire deck 124, the press-fit sleeve 100 is arranged at the first end 110 in a force-fitting manner by means of the connecting point 108 in the indentation 112. An inner surface of the fire deck opening 102 interacts directly with the component 106 (for example in a force-fitting and/or form-fitting manner). As a result, an inner diameter of the fire deck opening 102, more precisely an inner diameter of the fire deck opening at an end of the fire deck opening 102 that faces the combustion chamber 114, is smaller than in the case of conventional sleeves which extend over the entire length of the fire deck opening 102 in the fire deck 124 and are screwed, for example with an external thread of the sleeve, in the fire deck opening.

The term of fire deck opening 102 can relate here to a lowermost portion (i.e. the fire deck portion) of a cylinder head passage. The cylinder head passage can overall comprise a plurality of coaxial bores (for example stepped in diameter) throughout the cylinder head 104.

The fire deck 124 is bordered by a cooling water chamber 126 for receiving the water jacket 122. Since the press-fit sleeve 100 makes direct contact with the component 106 at the first end 110, and the lateral surface 120 of the press-fit sleeve 100 is in extensive heat exchange with the water jacket 122, effective cooling of the component 106 is ensured.

The connecting point 108 comprises an encircling, for example cylindrical, pressing surface 128. In the press-fitting state, the pressing surface 128 interacts in a frictionally locking manner with the indentation 112 by means of radial compressive forces. This interference fit of the pressing surface 128 in the indentation 112 extends parallel to a longitudinal axis of the pressing sleeve 100 over an axial extent 130 of the connecting point 108. That is to say, the axial extent 130 of the connecting point 108 is in the direction of the longitudinal axis the overlap between the pressing surface 128 and a cylindrical inner surface of the indentation 112 in the fire deck 124.

The axial extent 130 of the connecting point 108 is much smaller (i.e. a fraction significantly smaller than half) than an axial length 134 of the press-fit sleeve 100. The axial length 134 here is the overall length of the press-fit sleeve from the first end 100 as far as the second end 118 along the longitudinal axis of the press-fit sleeve 100.

In the exemplary embodiment shown in FIG. 1, the fire deck opening 102 comprises, between the indentation 112 and an end of the fire deck opening 102 that faces the combustion chamber 114, an internal thread 136 for the direct screw connection between the fire deck 124 and the component 106. The component 106 comprises a protrusion (for example closed in an encircling manner) above an external thread which is designed for interaction with the internal thread 136. The protrusion of the component 106 lies within the press-fit sleeve 100 against a step 144 of the connecting point 108 or can be brought into contact with the step 144.

In the press-fitting state, the connecting point 108 at the first end 110 of the press-fit sleeve 100 is arranged between the component 106 (more precisely the protrusion of the component 106) and the fire deck 124 (more precisely the indentation 112 in the fire deck 124). As a result, the component 106 holds the connecting point 108 in a form-fitting manner in the indentation 112 of the fire deck 124 via the screw connection to the internal thread 136 of the fire deck opening 102 and the contact against the radially inner step 144 of the press-fit sleeve 100.

The press-fit sleeve does not extend through the entire fire deck 124. For a particularly compact constructional form of the press-fit sleeve 100 and high oscillation strength (in particular flexural fatigue strength and/or endurance strength) of the fire deck 124, the axial extent 130 of the connecting point 108 is smaller, for example much smaller, than an axial extent 142 of the fire deck 124 between the indentation 112 and the combustion chamber 114. Furthermore, the distance between combustion chamber 114 and press-fit sleeve 100 in accordance with the axial extent 142 can prevent a thermal short circuit between combustion chamber 114 and water jacket 122.

Figure 2:
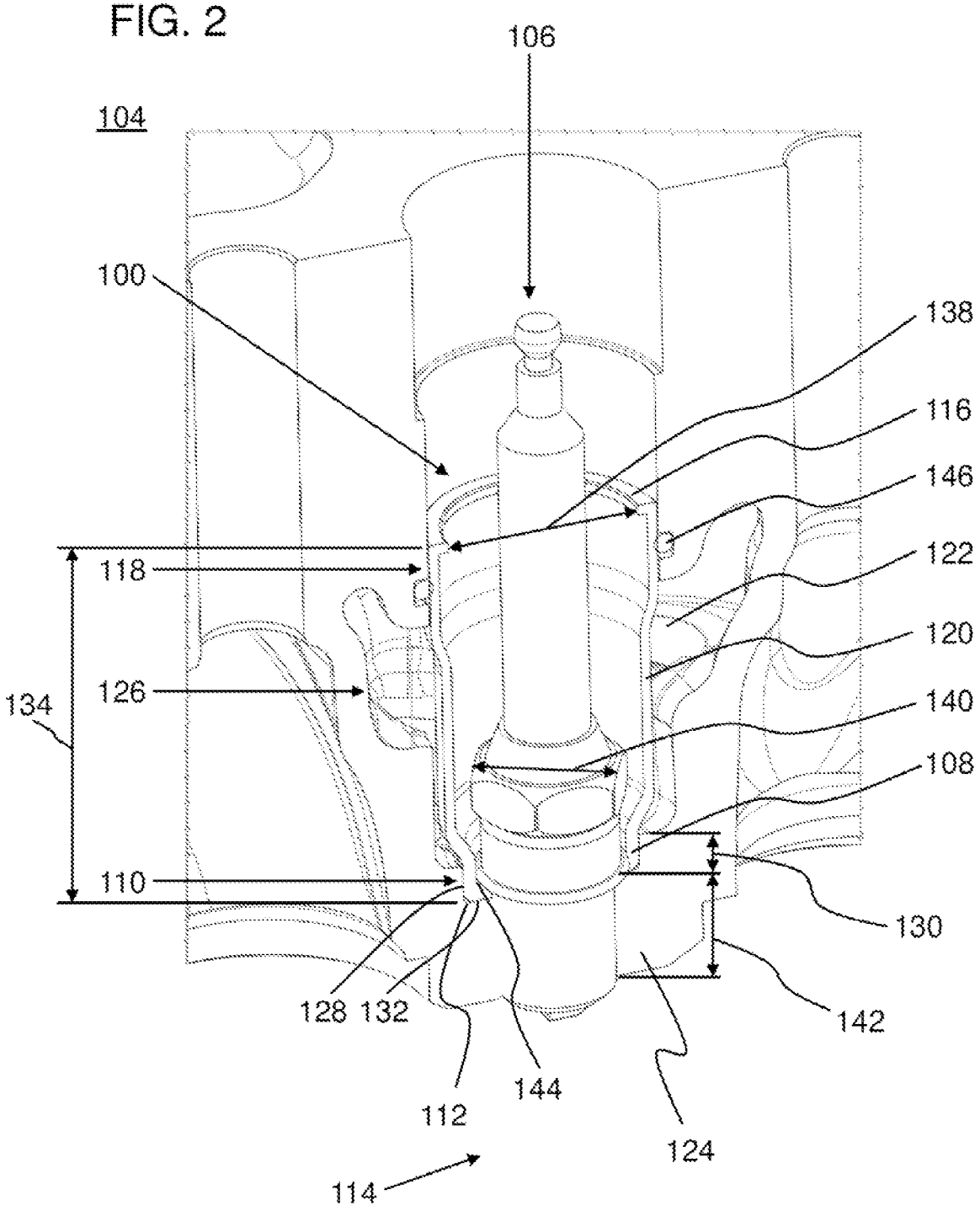
FIG. 2 shows a schematic perspective section of the exemplary embodiment of FIG. 1 with a perspective illustration of an exemplary component arranged therein.

FIG. 2 schematically shows a three-dimensional sectional illustration with a sectional plane between the cylinder head 104 and the press-fit sleeve 100 arranged therein. The longitudinal axis of the press-fit sleeve 100 is within the sectional plane (in the vertical direction in FIG. 2). A spark plug as an example of the component 106 in the press-fit sleeve 100 is arranged coaxially with respect to the longitudinal axis of the press-fit sleeve 100.

A spanner width 140 of the component 106 is smaller than an inner diameter 138 of the opening of the sleeve 100 at the second end 118. A spanner, for example a hexagon socket spanner, can be inserted through the opening of the sleeve 100 at the radially inwardly protruding step 116 via the component 106, which is mounted within the press-fit sleeve 100, in order to unscrew the component 106. Unlike in the case of a component 106 screwed to a conventional sleeve, during the unscrewing a torque will not be transmitted here to the press-fit sleeve 100, as a result of which, even after the unscrewing, the latter remains fastened because of the press fitting at the first end 110.

Furthermore, a seal 146 is arranged at the second end 118 in an encircling manner between the press-fit sleeve 100 and the filter head 104, the seal closing the lateral surface 120 fluid-tightly with respect to the cooling water chamber 126 at the second end 118. In the exemplary embodiment shown in FIGS. 1 and 2, an encircling groove is provided for this purpose above the cooling water chamber 126 (i.e. on the side facing away from the combustion chamber 114) in the cylinder head 104 in order to receive an O ring.

In addition to the press fitting, the press-fit sleeve 100 is optionally adhesively bonded at the connecting point 108. Alternatively or additionally, a seal, for example an O ring, can be arranged in an O ring groove (on the press-fit sleeve 100 or the fire deck 124) between the pressing surface 128 and the inner surface of the indentation 112 and/or on the end side on the contact surface 132 of the press-fit sleeve 100 in order to seal the cooling water chamber 126 from the combustion chamber 114 at the first end 110.

Whereas, in the above exemplary embodiment, the press-fit sleeve 100 is described for sealing and cooling a spark plug as an example of the component 106, the press-fit sleeve 100 and the functions thereof can be realised by further exemplary embodiments for each component 106 protruding through the fire deck opening 102 in the cylinder head 104 of the internal combustion engine. In particular, each component 106 tapering toward the combustion chamber 114, for example an injection nozzle for diesel fuel, can be sealed and cooled by an exemplary embodiment of the press-fit sleeve 100.

The internal thread 136 between the indentation 112 and the combustion chamber 114 can be dispensed with, depending on the component 106. For example, an injection nozzle can be fastened as a component 106 by means of an interference fit in the fire deck opening 102.

Installation of the component 106 by means of an exemplary embodiment of the press-fit sleeve 100 can comprise a step of pressing the press-fit sleeve 100 against a pressing device with a certain pressing force, and a subsequent step of screwing or pressing in the component 106. Alternatively, the press-fit sleeve 100 can be pressed in during the screwing or pressing of the component 106 into the indentation 112, i.e. simultaneously with the installation of the component 106. In the latter case, the component 106 (for example by means of its protrusion) presses the press-fit sleeve 100 into the indentation 112.

Removal of the press-fit sleeve 100 on the cylinder head 104 can comprise the step of pulling off or unscrewing the component 106 and the subsequent step of pulling off the press-fit sleeve from the radially inwardly protruding step 116. The connection between press-fit sleeve 100 and cylinder head 104 thus remains releasable and repairable.

The press-fit sleeve 100 permits a more favourable production of the cylinder head 104, in particular an automated installation of the press-fit sleeve 100 and/or of the component 106. The cutting of an additional thread in the fire deck opening for fastening a conventional sleeve can be dispensed with.

With reference to the above exemplary embodiments, the advantages, associated with the exemplary embodiments, of the press-fit sleeve 100 are apparent to a person skilled in the art. An indentation 112 for the interference fit of the press-fit sleeve 100 is provided in the fire deck 124, said press-fit sleeve 100 not extending continuously over the axial extent 142 of the fire deck 124 as far as the combustion chamber 114. For example, the axial extent 130 of the connecting point 108 is 5 mm or less. An internal thread 136 for the component 106 (for example a spark plug) can be cut into the fire deck 124, or a simple bore for the component 106 (for example a diesel injection nozzle) can be drilled therein. By contrast, in the case of a conventional sleeve, for example for an M18 spark plug, at least one M24 internal thread has to be cut in the fire deck in order to receive the conventional sleeve. The press-fit sleeve 100 therefore permits a diameter of the fire deck opening 102 toward the combustion chamber 114, which diameter is limited to the outer diameter of the respective component 106. Owing to the smaller opening, which is tailored to the outer diameter of the component 106, at that end of the fire deck opening 102 which faces the combustion chamber 114, a higher strength of the fire deck can be achieved.

The press-fit sleeve 100 is pressed and optionally adhesively bonded into the fire deck 124. The component 106 additionally keeps the press-fit sleeve 100 in position. The press-fit sleeve 100 is held down in the fire deck 124 in a force- and form-fitting and optionally integrally bonded manner. By means of the adhesive bonding of the press fitting (i.e. of the interference fit between the connecting point 108 and the indentation 112), the tightness at the first end 110 is ensured.

Since the component does not engage with its external thread in an internal thread of the sleeve, an unintentional twisting of the sleeve during the installation or during the removal of the component is ruled out.

Although the disclosure has been described with respect to exemplary embodiments, it is apparent to a person skilled in the art that various modifications may be undertaken and equivalents may be used in their place. Furthermore, a multiplicity of modifications can be undertaken in order to adapt a certain situation or a certain material to the teaching of the disclosure. Consequently, the disclosure is not restricted to the disclosed exemplary embodiments, but rather comprises all of the exemplary embodiments.

LIST OF REFERENCE SIGNS

100 Press-fit sleeve
102 Fire deck opening
104 Cylinder head of an internal combustion engine
106 Component
108 Connecting point of the press-fit sleeve
110 First end of the press-fit sleeve
112 Indentation at the fire deck opening
114 Combustion chamber of the internal combustion engine
116 Radially inwardly protruding step of the press-fit sleeve
118 Second end of the press-fit sleeve
120 Lateral surface of the press-fit sleeve
122 Water jacket
124 Fire deck of the internal combustion engine
126 Cooling water chamber for water jacket
128 Pressing surface of the connecting point
130 Axial extent of the connecting point
132 Contact surface of the connecting point
134 Axial length of the press-fit sleeve
136 Internal thread of the fire deck opening
138 Inner diameter of the press-fit sleeve at the second end
140 Spanner width of the component
142 Axial extent of the fire deck
144 Radially inner step of the connecting point
146 Seal at the second end

I claim:

1. A press-fit sleeve for sealing and cooling a component projecting through a fire deck opening in a cylinder head of an internal combustion engine, comprising:

a connecting point at a first end of the press-fit sleeve, said connecting point being configured to press fitting into an indentation at an end of the fire deck opening that faces away from a combustion chamber and including a radially inwardly curved collar with a contact surface, said press-fit sleeve not extending continuously over an axial extent of the fire deck as far as the combustion chamber;

a radially inwardly protruding step at a second end of the press-fit sleeve lying opposite the first end; and a lateral surface of the press-fit sleeve, said lateral surface being closed fluid-tightly between the first end and the second end and being or being able to be brought into contact with a water jacket surrounding the press-fit sleeve.

2. The press-fit sleeve according to claim 1, wherein the component comprises an injection nozzle and/or a spark plug.

3. The press-fit sleeve according to claim 1, wherein the connecting point comprises a cylindrical pressing surface.

4. The press-fit sleeve according to claim 3, wherein an axial extent of the connecting point is much smaller than an axial length of the press-fit sleeve.

5. The press-fit sleeve according to claim 3, wherein the pressing surface or the contact surface is configured to connecting fluid-tightly to the indentation.

6. The press-fit sleeve according to claim 3, wherein the pressing surface or the contact surface are connected or connectable to the indentation in a force-fitting or integrally bonded manner.

7. The press-fit sleeve according to claim 1, wherein a diameter of the press-fit sleeve at the first end is smaller than a diameter of the press-fit sleeve at the second end.

8. A cylinder head of an internal combustion engine, comprising:

a fire deck with a fire deck opening;

a press-fit sleeve for sealing and cooling a component projecting through the fire deck opening, the press-fit sleeve including, a connecting point at a first end of the press-fit sleeve, said connecting point being configured to press fitting into an indentation at an end of the fire deck opening that faces away from a combustion chamber and including a radially inwardly curved collar with a contact surface, said press-fit sleeve not extending continuously over an axial extent of the fire deck as far as the combustion chamber;

a radially inwardly protruding step at a second end of the press-fit sleeve lying opposite the first end; and a lateral surface of the press-fit sleeve, said lateral surface being closed fluid-tightly between the first end and the second end and being or being able to be brought into contact with a water jacket surrounding the press-fit sleeve; and a cooling water chamber, which is adjacent to the fire deck, for receiving the water jacket which the lateral surface of the press-fit sleeve closes in a fluid-tight manner between the first end and the second end.

9. The cylinder head according to claim 8, wherein the fire deck opening has, between the indentation and an end of the fire deck opening that faces the combustion chamber, an internal thread for a screw connection to the component.

10. The cylinder head according to claim 9, wherein the component holds down a radially inner step of the connecting point with respect to the fire deck opening via the screw connection.

11. The cylinder head according to claim 8 wherein the press-fit sleeve is connected or connectable to the fire deck in a form-fitting manner by means of the component.

12. The cylinder head according to claim 8, wherein the axial extent of the fire deck is greater than an axial extent of the connecting point.

13. The cylinder head according to claim 8, wherein a seal arranged at the second end in an encircling manner between the press-fit sleeve and the cylinder head closes the lateral surface fluid-tightly with respect to the cooling water chamber.

14. A vehicle comprising:

an internal combustion engine;

a cylinder head connected to the internal combustion head, the cylinder head including, a fire deck with a fire deck opening;

a press-fit sleeve for sealing and cooling a component projecting through the fire deck opening, the press-fit sleeve including, a connecting point at a first end of the press-fit sleeve, said connecting point being configured to press fitting into an indentation at an end of the fire deck opening that faces away from a combustion chamber and including a radially inwardly curved collar with a contact surface, said press-fit sleeve not extending continuously over an axial extent of the fire deck as far as the combustion chamber;

a radially inwardly protruding step at a second end of the press-fit sleeve lying opposite the first end; and a lateral surface of the press-fit sleeve, said lateral surface being closed fluid-tightly between the first end and the second end and being or being able to be brought into contact with a water jacket surrounding the press-fit sleeve; and a cooling water chamber, which is adjacent to the fire deck, for receiving the water jacket which the lateral surface of the press-fit sleeve closes in a fluid-tight manner between the first end and the second end.

* * * * *